United States Patent [19]

Houdion

[11] 4,233,830

[45] Nov. 18, 1980

[54] METHOD FOR THE CONTINUOUS PRODUCTION OF A BRIGHT COPPER ROD BY THE ROLLING OF STOCK OBTAINED FROM A CONTINUOUS CASTING APPARATUS

[75] Inventor: Pierre Houdion, Vaires, France

[73] Assignee: Secim, Courbevoie, France

[21] Appl. No.: 961,386

[22] Filed: Nov. 14, 1978

Related U.S. Application Data

[63] Continuation-in-part of Ser. No. 852,568, Nov. 17, 1977, abandoned, which is a continuation of Ser. No. 734,270, Oct. 20, 1976, abandoned.

[51] Int. Cl.[3] ..... B21B 9/00; B21B 45/08

[52] U.S. Cl. ..... 72/38; 29/81 B; 72/39; 72/40

[58] Field of Search ..... 29/81 A, 81 B; 72/38, 72/39, 41, 43, 45, 200–202, 342, 364, 40; 134/15, 17; 266/121; 164/69, 76, 89, 270

[56] References Cited

U.S. PATENT DOCUMENTS

| | | | |
|---|---|---|---|
| 2,242,024 | 5/1941 | Dillon | 29/81 A |
| 2,357,695 | 9/1944 | Skowron | 134/17 X |
| 2,394,514 | 2/1946 | Evans et al. | 134/17 X |
| 3,257,835 | 6/1966 | Cofer et al. | 72/364 |
| 3,573,118 | 3/1971 | Kocks | 148/156 |
| 3,608,344 | 9/1971 | Schwan | 72/38 |
| 3,766,763 | 10/1973 | Cofer et al. | 72/201 X |
| 3,983,889 | 10/1976 | Thym et al. | 134/15 X |
| 3,986,378 | 10/1976 | Alekhin et al. | 72/38 |
| 4,043,166 | 8/1977 | Leroy | 72/39 |

*Primary Examiner*—Ervin M. Combs

*Attorney, Agent, or Firm*—Haseltine, Lake & Waters

[57] ABSTRACT

A method and apparatus for the continuous production of bright copper rod from stock discharged from a continuous casting machine in which an oxide layer formed on the stock during its passage from the continuous casting machine in the atmosphere is subjected to an initial breakage and separation operation by discharging a chemically active liquid at a relatively low pressure against the oxide layer followed by descaling the stock after the initiation of the breakage of the layer by projecting jets of liquid at a relatively high pressure against the stock. The stock which is now free from oxide layer is rolled in a rolling mill in the presence of cooling and lubricating liquid which isolates the stock from the outside atmosphere and allows the formation of rod in the stands of the rolling mill. The rod obtained from the rolling mill is cooled by passage through a duct in counterflow with a cooling liquid such that the rod leaves the duct at a temperature below 80° C.

3 Claims, 1 Drawing Figure

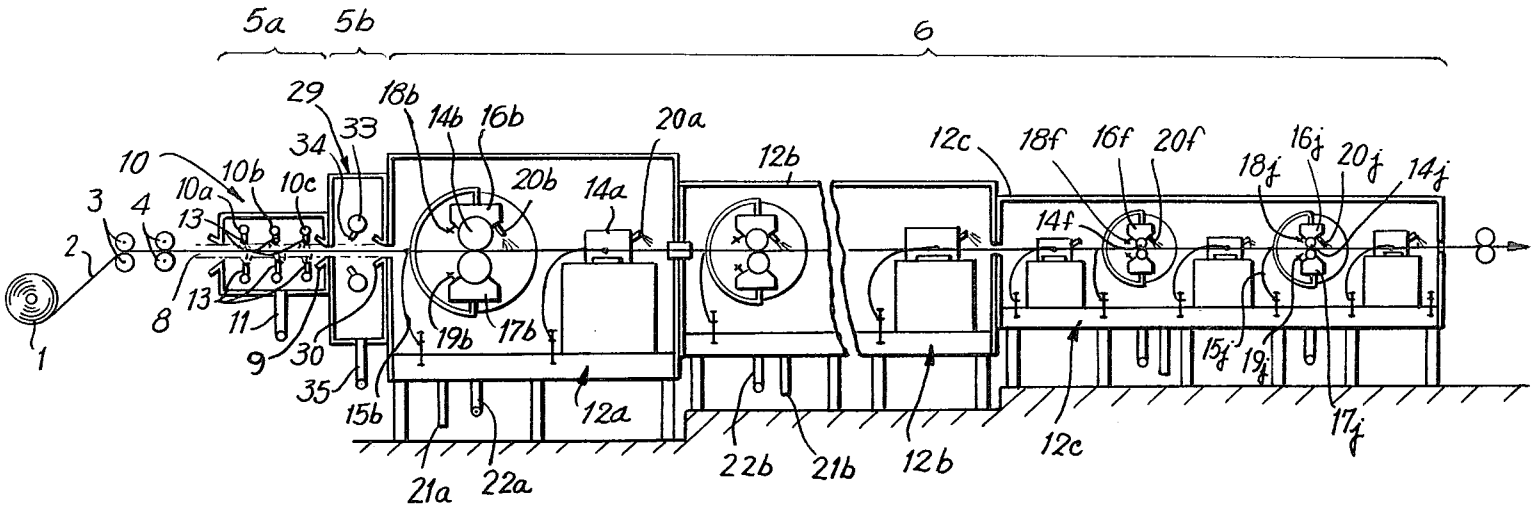
1
2
3
4
5a
5b
6
8
9
10
10a
10b
10c
11
12a
12b
12c
13
14a
14b
14f
14j
15b
15f
16b
16f
16j
17b
17j
18b
18f
18j
19b
19j
20a
20b
20f
20j
21a
21b
22a
22b
29
30
33
34
35
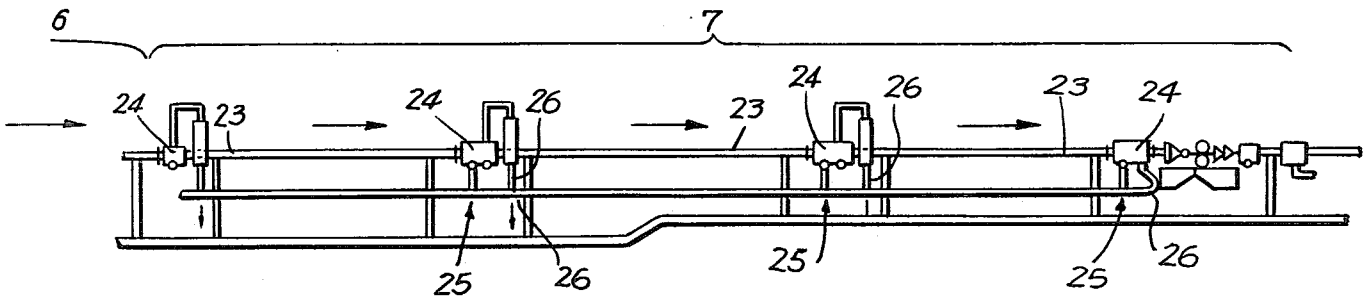
6
7
23
24
25
26

METHOD FOR THE CONTINUOUS PRODUCTION OF A BRIGHT COPPER ROD BY THE ROLLING OF STOCK OBTAINED FROM A CONTINUOUS CASTING APPARATUS

CROSS-RELATED APPLICATION

This Application is a continuation-in-part of Ser. No. 852,568 filed Nov. 17, 1977, now abandoned, which in turn is a continuation of Ser. No. 734,270, filed Oct. 20, 1976, now abandoned.

FIELD OF THE INVENTION

The invention relates to a method and installation for the continuous production of a bright copper rod by rolling stock obtained from a continuous casting apparatus.

PRIOR ART

In installations for the production of metal rods comprising a continuous casting machine, for example, a wheel-type machine, followed by a continuous rolling mill, it is very difficult to avoid oxidation of the stock between the continuous casting machine and the rolling mill.

It has been proposed to surround the stock during its passage from the casting machine to the mill with a neutral or reducing atmosphere, but this is difficult to put into practice and requires complicated and costly installations. In the majority of installations employed at present the stock therefore passes through a certain distance exposed to the air, this distance being generally considerable. Consequently, the stock leaving the continuous casting machine at high temperature is oxidized during its passage in contact with the air and enters the rolling mill covered with a more or less heavy layer of scale depending upon the conditions under which the passage from the continuous casting machine to the rolling mill is carried out.

During rolling, the scale is broken as a consequence of mechanical forces and thermal shocks due to spraying the blank with the liquid for cooling and lubricating the rolling mill. This scale may then become embedded in the rod and spoil its surface. There is also the risk of particles of scale sticking in guideways and scratching the rod during the course of rolling as it passes through the guideways.

Methods and apparatus have previously been proposed for cleaning the rod either by scraping or brushing during the course of rolling, or by chemical pickling with an acid or non-acid product in the rolling mill or in a duct arranged at the outlet from the rolling mill.

Additionally, a process is known, in which jets of a scouring liquid are projected on the blank between the first and second stages of the rolling mill. In this process, in fact, scales are removed in the rolling mill itself and not eliminated from the casing of the rolling mill.

In all these prior methods, the risk of embedding particles of scale in the rod has not been eliminated, because the stock to be rolled enters the rolling mill covered with a layer of oxide and therefore the risk of embedding the scale in the rod exists from the first stands of the rolling mill.

Also, because flakes of oxide are detached inside the rolling mill the risk of scratching the rod in the guideways is increased.

Moreover, the efficiency of all these methods as regards the removal of oxides of the bar is concerned, is not optimum.

SUMMARY OF THE INVENTION

It is an object of the invention to provide a method of continuous production of bright copper rod from a stock obtained by continuous casting, said method comprising:

initiating the breakage and separation of the oxide layer formed on the stock during its passage to the rolling mill by the thermal shock and the chemical action of jets of a chemically active liquid at a pressure of 2–3 bars, the stock being subjected to this action of these low pressure jets for a time from 1 to 5 seconds before entry of the stock into the rolling mill, descaling said stock after initiation of the breakage of the oxide layer and before its entry in the rolling mill by projecting on said stock jets of liquid at a pressure of 200–220 bars, thus eliminating the scales of oxide partially detached from the stock during the preceeding step, rolling said stock in said rolling mill in the presence of a cooling and lubricating liquid at a pressure of 2–3 bars which isolates said stock from the outside atmosphere during its passage through said rolling mill;

cooling the rod obtained from said rolling mill by passing said rod through a duct and causing cooling liquid to flow through said duct in a direction opposite to the direction of travel of said rod, said rod leaving said duct at a temperature below 80° C.

By use of the above method the risks of embedding particles of oxide in the rod during the course of rolling and the risks of scratching the rod by particles of oxide detached from the stock during the course of rolling can be avoided.

Finally, by use of the above method, it becomes possible to produce bright copper rod without a step of pickling the rod after the passage in the rolling mill.

It is another object of the invention to provide an apparatus for carrying out the above method, said apparatus comprising in succession in the direction of travel of a continuous stock for a rod:

a pre-pickling chamber defining a path for a continuous rod stock therethrough, comprising at least two sets and preferably three sets of nozzles situated approximately in a transverse plane around the stock and equally spaced along the path of the stock in said pre-pickling chamber, said nozzles being fed with a chemically active liquid at low pressure, a descaling chamber in communication with the interior of said pre-pickling chamber defining a path for continuous rod stock therethrough and comprising a set of nozzles arranged around the stock approximately in a transverse plane fed with a liquid under high pressure and means for discharging the liquid and flakes of oxide detached from the stock, means for feeding continuous rod stock through said descaling chamber and pre-pickling chamber, a rolling mill in communication with the interior of said descaling chamber and comprising a plurality of rolling stands arranged in a closed casing, each stand comprising means for spraying the rolls of said mill and the rod stock between said stands with liquid for cooling and lubricating said mill and for maintaining a non-oxidizing atmosphere around the rod stock during rolling, and means for discharging the cooling and lubricating liquid; and an elongated cooling duct communicating with the interior of said rolling mill and defining a passage for rod from said rolling mill therethrough, said duct comprising at least one tubular section, means for supplying a cooling liquid to said section and connected to said section in the vicinity of its downstream end remote from said rolling mill, and means connected to said section in the vicinity of its upstream end near said rolling mill for discharging cooling liquid from said section.

The invention will be more fully understood from the following description of an embodiment thereof, given by way of example only, with reference to the accompanying drawing.

BRIEF DESCRIPTION OF THE DRAWING

In the drawing the single FIGURE is a diagrammatic view in elevation of an embodiment of an installation according to the invention and wherein the pre-pickling chamber, the descaling chamber and the rolling mill casing are shown open to illustrate the apparatus located therein.

DETAILED DESCRIPTION

In the FIGURE there is seen a casting wheel 1 of a continuous casting machine, the wheel having a peripheral casting groove closed by a metal band, the groove and the metal band forming a casting mold for a metal bar 2 which leaves the casting wheel under the drive of pinch drive rolls 3. A crop shear 4 enables portions of the bar unsuitable for rolling to be cropped.

The installation for production of bright copper wire from the bar or stock 2 comprises four portions 5*a*, 5*b*, 6 and 7. The first portion 5*a* into which the copper bar enters includes a chamber 10 for the pre-pickling of the bar.

The chamber 10 includes inlet and outlet guides 8 and 9 for the bar and three toroidal pipes 10*a*, 10*b* and 10*c* which are centered on the path of the bar through the chamber and which are fed with a liquid containing water and a weak proportion of an alcohol under relatively low pressure of between 2–3 bars.

The length of the chamber 10 is about one meter.

Nozzles 13 are mounted on the radially inner surfaces of the pipes 10*a*, 10*b* and 10*c*, directed towards the stock. The pre-pickling chamber 10 also comprises a pipe 11 for the discharge of the pre-pickling liquid connected to the lower part of the chamber 10.

The second portion 5*b* includes a chamber 29 for descaling the bar using a liquid under high pressure. This liquid may be the same liquid as in the chamber 10 of the installation. The chamber 29 includes an outlet guide 30 for the bar and a toroidal pipe 33 which is centered on the path of the bar through the chamber and which is fed with liquid under relatively high pressure of about 210 bars.

Flat jet nozzles 34 are mounted on the radially inner surface of the pipe 33, the nozzles being directed towards the rod and inclined in the upstream direction of the rod at an angle of about 10°.

The descaling chamber also comprises a pipe 35 connected to the lower part of the chamber 29 for the discharge of the descaling liquid with flakes of oxide to a settling and filtration unit enabling the descaling liquid to be recycled.

The length of the descaling chamber is about 30 cm.

The third portion 6 includes a rolling mill which has a casing 12 inside which are arranged a plurality of roll stands provided with pairs of rolls 14*a* to 14*j* arranged with their axes alternately horizontal and vertical.

Each of the stands is equipped with an inlet 15 for liquid for cooling and lubrication, two spray distributors 16 and 17 supplied by the pipework 15 and three spray nozzles 18, 19 and 20 likewise supplied by pipe 15 with liquid for cooling and lubricating the rolling mill. The distributors 16 and 17 as well as the nozzles 18 and 19 atomize the lubricating and cooling liquid and direct it onto the rolls 14 of the mill. The nozzles 20 spray the rod as it passes between two successive stands.

The mill casing 12 comprises three portions 12*a*, 12*b* and 12*c* corresponding to a roughing train, an intermediate train and a finishing train. In the lower portion of each of the casing portions are fixed one or more pipes 21 for inlet of the cooling and lubricating liquid and one or more pipes 22 for discharge of the liquid after its passage through the mill. It is necessary to provide, in general, one discharge pipe for two stands of the mill in order to have correct flow of the lubricating and cooling liquid.

The third and last portion 7 of the installation comprises a duct through which the rod passes before passing to a reeler. The duct is formed of tubular sections 23 connected together by boxes 24, the boxes each being provided with an inlet for cooling liquid supplied by a pipe 25 and supplied to the section located towards the rolling mill or the upstream section, and an outlet for cooling liquid coming from the section located towards the outlet of the wire or the downstream section, the liquid being discharged by a pipe 26. The boxes 24 each comprise a sealing device which isolates the cooling liquid inlet from the outlet, leaving a passage for the moving rod.

The operation of the installation which has just been described will now be described.

The continuously cast bar 2 which leaves the casting wheel 1 is driven by the rolls 3 towards the pre-pickling chamber 10.

During its passage through the air between the outlet of the casting wheel and the pre-pickling chamber, the bar at 950° becomes covered with a thick layer of oxide mainly comprising copper oxide ($Cu_2O$). In fact, this oxide is formed abundantly on the surface of copper exposed to the atmosphere as soon as the temperature of the metal exceeds 150° C. The bar covered with oxide enters the pre-pickling chamber 10 where the nozzles 13 on the pipes 10*a* and 10*b* project liquid at a pressure of 2–3 bars on to the surface of the oxidized bar. This spraying causes breakage of the thick layer of oxide which covers the bar at its entry into the pre-pickling chamber 5*a* by thermal shock.

In this part of the installation, the speed of the bar coming from the casting wheel is rather low (15 m/mn).

The bar remains for about 4 seconds in the pre-pickling chamber 10, the length of which is about one meter. During this time, the bar is in contact with the liquid projected by the nozzles and the vapor produced when the liquid contacts the hot copper bar. The copper oxide is thus partially reduced and detached from the bar as the vapor penetrates under the broken layer of oxide.

Then, the bar enters the descaling chamber 29 in which jets of liquid under a high pressure of about 210 bars are projected against the surface of the bar. The flakes of oxide are thus removed from the bar and carried along with the liquid at the lower part of the chamber 29.

The efficiency of the descaling jets is very high because the flakes of oxide have been partly detached by the thermal and chemical action of the fluid in the chamber 5*a*.

Thus, a single set of nozzles is sufficient, the length of the chamber 29 thereby being very small.

The bar then enters the rolling mill portion 6 cleaned of its surface oxide before passing into the first stand. The very short duration descaling spraying under high pressure leads to relatively slight cooling of the bar with the result that the bar which enters the rolling mill is still at a temperature enabling hot forming. During the passage of the bar into the mill and its transformation into rod, the metal is continuously isolated from the outside atmosphere by the liquid sprayed onto the rolls from the distributors 16 and 17 and the nozzles 18 and 19 of the stands and on to the rod from the nozzles 20 between the stands. The rod thus isolated from the oxidizing atmosphere may be rolled without re-oxidation and the rolling pressures together with the spraying by the cooling and lubricating liquid enable elimination of any skin of oxide which may still remain on the bar or the rod during the course of rolling. The particles of oxide thus detached from the copper bar are eliminated by the pipes 22 which lead the mill cooling liquid to a filtration plant. Hence, at the outlet from the mill a bright rod is obtained, free of oxide layer but at a temperature of the order of 600° C. at which considerable re-oxidation of the copper is possible, this re-oxidation being particularly rapid above 150° C.

The mill cooling and lubricating liquid is an aqueous solution of rolling mill oil to which may be added a non-acid copper scourer, for example, an alcohol.

At the outlet from the rolling mill the rod enters the cooling duct portion 7, the role of which is to bring the temperature of the rod down to a value low enough at which re-oxidation is not possible. In practice the outlet temperature of the rod should not be higher than 80° C.

In order to effect this cooling, water with a light proportion of reducing agent at 35° C. is admitted through the pipes 25, this liquid circulating in the pipe in countercurrent to the rod leaving the rolling mill and leaving through the pipes 26 at 80° C. The proportion of reducing agent in the liquid circulating in the cooling tube is very low compared to the proportion necessary for the cleaning of the bar by non-acid pickling. This reducing agent is useful, in fact, to prevent a re-oxidation of the rod. The length of the sections of the duct and the number of these sections are such that the metal leaves the cooling duct at a temperature below 80° C.

It may be seen that by this method the copper bar entering the rolling mill is relieved of its oxide layer and transformed into rod while screened from re-oxidation and under conditions such that slight deoxidation of any layer of oxide which may remain on the wire or the bar can occur and the wire enters the cooling duct, without any surface oxides, to be brought to a temperature at which re-oxidation of the copper is no longer possible in the atmosphere.

The invention is not intended to be restricted to the embodiment which has just been described, but on the contrary comprises all variants and modifications. For example, the liquids for pre-pickling, descaling, lubricating and cooling, may be different from those which have been disclosed without departing from the scope of the invention. Any liquid favoring chemical cleaning and compatible with the materials employed for the construction of the rolling mill may in fact be employed in the pre-pickling zone.

Any liquid preventing re-oxidation of the copper may be employed in the descaling zone, the rolling mill and the cooling tube.

As the pressure of the liquid is the same in the rolling mill and the pre-pickling chamber, it is possible to conceive a single circuit to feed these two parts of the installation.

What is claimed is:

1. A method for the continuous production of bright copper rod from stock after discharge from a continuous casting machine, said stock having been exposed to air and being treated prior to entry into a rolling mill, said method including the steps of:

(a) initiating the breakage and separation of an oxide layer formed on the stock during its passage to the rolling mill by thermal shock and the chemical action of jets of a chemically active liquid at a relatively low pressure of 2–3 bars, the stock being subjected to this action of the low pressure jets for a time from 1 to 5 seconds before entry of the stock into the rolling mill, (b) descaling said stock after initiation of the breakage of the oxide layer and before its entry in the rolling mill by projecting on said stock jets of liquid at a relatively high pressure of 200–220 bars thus eliminating the flakes of oxide partially detached from the stock during the preceding step, wherein the duration of said descaling is less than the time required for initiating the breakage and separation of the oxide layer as recited in step (b) to simultaneously effect descaling and to maintain said stock as a temperature enabling hot rolling, (c) hot rolling said stock in said rolling mill in the presence of a cooling and lubricating liquid which isolates said stock from the outside atmosphere during its passage through said rolling mill, and, (d) cooling the rod obtained from said rolling mill by passing said rod through a duct and causing cooling liquid to flow through said duct in a direction opposite to the direction of travel of said rod such that the rod leaves said duct at a temperature below 80° C.

2. The method as claimed in claim 1, wherein the chemically active liquid contains an alcohol.

3. The method as claimed in claim 1 wherein the interval between the end of step (a) and the beginning of step (c) is about 1.2 sec.

* * * * *